US007625850B2

(12) United States Patent
Horaguchi et al.

(10) Patent No.: US 7,625,850 B2
(45) Date of Patent: Dec. 1, 2009

(54) LUBRICATING OIL COMPOSITION

(75) Inventors: Norihisa Horaguchi, Aichi-ken (JP); Shiki Matsuo, Aichi-ken (JP); Hideo Kometani, Aichi-ken (JP); Naomoto Ishikawa, Aichi-ken (JP); Tatsushi Seko, Aichi-ken (JP); Yusuke Kinoshita, Aichi-ken (JP); Masaru Seto, Osaka (JP); Kimihito Hitotsumatsu, Aichi-ken (JP)

(73) Assignees: Mitsubishi Heavy Industries, Ltd., Tokyo (JP); Sato Special Oil Co., Ltd., Osaka (JP)

( * ) Notice: Subject to any disclaimer, the term of this patent is extended or adjusted under 35 U.S.C. 154(b) by 382 days.

(21) Appl. No.: 11/087,741

(22) Filed: Mar. 24, 2005

(65) Prior Publication Data

US 2005/0222000 A1 Oct. 6, 2005

(30) Foreign Application Priority Data

Mar. 31, 2004 (JP) ..... 2004-108105
Feb. 10, 2005 (JP) ..... 2005-035276

(51) Int. Cl.
*C10M 105/38* (2006.01)
*C10M 133/12* (2006.01)
*C10M 105/22* (2006.01)

(52) U.S. Cl. ..... 508/485; 508/563; 508/459

(58) Field of Classification Search ..... 508/485, 508/563, 459
See application file for complete search history.

(56) References Cited

U.S. PATENT DOCUMENTS 3,452,056 A 6/1969 Sundholm
3,505,225 A * 4/1970 Wheeler ..... 508/497
5,145,593 A 9/1992 Takashima
5,358,652 A * 10/1994 Macpherson ..... 508/271
5,464,549 A * 11/1995 Sieberth ..... 508/232
5,726,135 A * 3/1998 Khorramian ..... 508/444
5,768,755 A * 6/1998 Hemmerich ..... 26/93
5,773,391 A * 6/1998 Lawate et al. ..... 508/257

(Continued)

FOREIGN PATENT DOCUMENTS

DE 69510 755 T2 3/2000

(Continued)

OTHER PUBLICATIONS

Korean Office Action dated Jun. 9, 2006 and received by client Jun. 16, 2006.

(Continued)

*Primary Examiner*—Glenn Caldarola
*Assistant Examiner*—Jim Goloboy
(74) *Attorney, Agent, or Firm*—Westerman, Hattori, Daniels & Adrian, LLP

(57) ABSTRACT

A high-temperature lubricating oil composition is provided, which is resistant to hardening and sludge formation, and displays minimal evaporation loss and superior thermal stability, even under practical high-temperature open system conditions such as those found in a tenter. A lubricating oil composition that provides excellent lubrication without damaging members used within working machinery is also provided. The lubricating oil composition comprises a polyolester based synthetic oil and a $C_{12}$ to $C_{72}$ fatty acid and/or a diphenylamine derivative containing an arylalkyl group with a number average molecular weight of 400 to 800.

26 Claims, 5 Drawing Sheets

U.S. PATENT DOCUMENTS

| | | | | |
|---|---|---|---|---|
| 2003/0125219 | A1* | 7/2003 | Tazaki et al. | 508/422 |
| 2005/0070449 | A1* | 3/2005 | Roby et al. | 508/485 |

FOREIGN PATENT DOCUMENTS

| | | |
|---|---|---|
| EP | 0 712 834 B1 | 7/1999 |
| JP | 07-305079 | 11/1995 |
| JP | 09-003468 | 1/1997 |
| JP | 2000-129279 | 5/2000 |
| JP | 2001-049281 A | 2/2001 |
| JP | 2001-303086 | 10/2001 |

OTHER PUBLICATIONS

German Office Action dated Jun. 26, 2006.
Japanese Office Action dated Jan. 8, 2008 (mailing date), issued in corresponding Japanese Patent Application No. 2005-035276.

* cited by examiner

EXAMPLE 1 EXAMPLE 2 COMPARATIVE EXAMPLE 2 COMPARATIVE EXAMPLE 1

COMPARATIVE EXAMPLE 1

COMPARATIVE EXAMPLE 2

EXAMPLE 1

LUBRICATING OIL COMPOSITION

BACKGROUND OF THE INVENTION

1. Field of the Invention

The present invention relates to a lubricating oil composition that displays excellent thermal stability and lubrication properties, does not damage members used in working machinery, and is ideal for use in high-temperature environments.

The present invention relates particularly to a lubricating oil composition that is ideal as a chain lubricant for a tenter or the like.

2. Description of Related Art

Lubricating oils containing a polyolester based oil as the base oil display comparatively long hardening times (the length of time required for loss of fluidity) and low evaporation loss, and consequently offer excellent thermal stability. As a result, these types of lubricating oils have been widely commercialized as high-temperature lubricating oils, in lubricants for tenters used for the transverse stretching of resin films such as polypropylene (PP), polyethylene terephthalate (PET), polyamide (PA), or polyethylene (PE), or woven fabric, nonwoven fabric, building material, or the like in an open system at a temperature of approximately 200° C.

However, many of these lubricating oils generate large quantities of oxidation polymers and sludge, meaning they are not entirely suitable for practical application. In contrast, those lubricating oils which are deemed to suffer minimal sludge generation tend to have shorter hardening times, and larger levels of evaporation loss, meaning their inherent lubrication properties are inferior.

Furthermore, amongst high-temperature lubricating oils containing a base oil as described above, the addition of a phosphorus based compound or a sulfur based compound of a lubricant as an extreme pressure agent or an anti-wear agent is a common technique used to impart more favorable lubrication characteristics (for example, see Japanese Unexamined Patent Application, First Publication No. 2000-129279 and Japanese Unexamined Patent Application, First Publication No. 2001-303086). However, even lubricating oils containing these conventional additives can suffer problems during practical application. For example, under working machinery conditions, these additives can form secondary products that can cause blockages within the oil supply lines, or products generated by the decomposition of these additives can cause elution of those members within the machinery formed from silicone rubber or the like. (Note, in this description, the softening and deterioration of silicone based rubbers such as vinyl methyl silicone (VMQ) caused by a reduction in the molecular weight resulting from cleavage of the principal chain is referred to as "elution.")

Accordingly, a lubricating oil that displays favorable high-temperature stability with no loss of lubrication properties, and does not effect the members used in working machinery, even when used in high-temperature open systems such as tenters, has been eagerly sought.

BRIEF SUMMARY OF THE INVENTION

The present invention takes the circumstances described above into consideration, with an object of providing a lubricating oil composition which is resistant to hardening (oxidation polymerization) and sludge formation, and displays minimal evaporation loss and superior thermal stability, even under practical high-temperature open system conditions such as those found in a tenter.

In order to achieve this object, a high-temperature lubricating oil composition of the present invention employs the aspects described below.

A lubricating oil composition according to the present invention comprises a base oil component containing a polyolester based synthetic oil, and a diphenylamine derivative containing an arylalkyl group with a number average molecular weight of 400 to 800.

Adding the diphenylamine derivative containing an arylalkyl group with a number average molecular weight of 400 to 800 to this lubricating oil composition enables the evaporation loss of the composition to be suppressed.

The quantity of the aforementioned diphenylamine derivative within a lubricating oil composition of the present invention is preferably within a range from 2 to 8% by weight.

Furthermore, the quantity of the aforementioned diphenylamine derivative is even more preferably within a range from 3 to 7% by weight.

Moreover, the quantity of the aforementioned diphenylamine derivative is most preferably approximately 6% by weight.

If the quantity of the diphenylamine derivative exceeds 8% by weight, then the evaporation loss becomes constant, and no additional effect is achievable. Furthermore, if the quantity of the diphenylamine derivative is too large, then supersaturation of the derivative itself can actually cause hardening. Accordingly, the quantity of the diphenylamine derivative is preferably no more than 8% by weight, and is even more preferably 7% by weight or less. In contrast, if the quantity of the diphenylamine derivative amounts to less than 2% by weight of the total weight of the lubricating oil composition, then the effect of the additive in suppressing evaporation loss is inadequate. Accordingly, the quantity of the diphenylamine derivative is preferably at least 2% by weight, and is even more preferably 3% by weight or greater.

From the viewpoint of best suppressing evaporation loss and hardening of the lubricating oil composition, a diphenylamine derivative quantity of approximately 6% by weight is the most desirable.

In a lubricating oil composition of the present invention, the polyolester based synthetic oil may comprise an ester in which the alcohol component is dipentaerythritol, pentaerythritol, trimethylolpropane or neopentyl glycol.

In a lubricating oil composition of the present invention, the diphenylamine derivative may be 4,4-bis(dimethylbenzyl) diphenylamine.

A lubricating oil composition of the present invention may comprise a base oil component containing a polyolester based synthetic oil and a $C_{12}$ to $C_{72}$ fatty acid. This fatty acid may be a straight chain fatty acid, a branched chain fatty acid, or a mixture thereof.

By employing a $C_{12}$ to $C_{72}$ fatty acid as one component of the base oil, this lubricating oil composition is able to impart excellent lubrication (with a high load bearing capacity), without the use of additives that tend to cause elution of those members within working machinery formed from silicone rubber or the like.

In a lubricating oil composition of the present invention, the quantity of the fatty acid described above is preferably no more than 10% by weight.

Furthermore, in a lubricating oil composition of the present invention, the quantity of the fatty acid is preferably at least 1% by weight.

Moreover, in a lubricating oil composition of the present invention, the quantity of the fatty acid is most preferably approximately 2% by weight.

If the quantity of the fatty acid within the lubricating oil composition exceeds 10% by weight, then the lubricating oil composition suffers an undesirable loss of heat resistance. Furthermore, in order to ensure satisfactory load bearing capacity, the quantity of the fatty acid within the lubricating oil composition is preferably at least 1% by weight. In terms of the balance between heat resistance and load bearing capacity, a fatty acid content within the lubricating oil composition of approximately 2% by weight is the most desirable.

In a lubricating oil composition of the present invention comprising the base oil component containing a polyolester based synthetic oil and a $C_{12}$ to $C_{72}$ fatty acid, the polyolester based synthetic oil may comprise an ester in which the alcohol component is dipentaerythritol, pentaerythritol, trimethylolpropane or neopentyl glycol.

In a lubricating oil composition of the present invention, the fatty acid may comprise an unsaturated fatty acid.

Furthermore, in a lubricating oil composition of the present invention, the fatty acid may comprise a saturated fatty acid.

A lubricating oil composition of the present invention may comprise a base oil component containing a polyolester based synthetic oil and a $C_{12}$ to $C_{72}$ fatty acid, and a diphenylamine derivative containing an arylalkyl group with a number average molecular weight of 400 to 800.

By incorporating both a $C_{12}$ to $C_{72}$ fatty acid and a diphenylamine derivative containing an arylalkyl group with a number average molecular weight of 400 to 800, this lubricating oil composition enables the evaporation loss of the composition to be suppressed, while imparting excellent lubrication (with a high load bearing capacity), without the use of additives that tend to cause elution of those members within working machinery formed from silicone rubber or the like.

According to the present invention, a lubricating oil composition is obtained which is resistant to hardening and sludge formation, and displays minimal evaporation loss and superior thermal stability, under working machinery conditions.

Furthermore, according to the present invention, a lubricating oil composition is obtained which provides excellent lubrication without damaging members used within working machinery.

A lubricating oil composition of the present invention is particularly suited to use as the lubricating oil within high-temperature open systems, such as the lubricating oil for a tenter used for the transverse stretching of resin films, woven fabric, nonwoven fabric, building material, or the like in an open system at a high temperature of approximately 200° C. Furthermore, in addition to use as a lubricating oil for tenters, a lubricating oil composition of the present invention can also be favorably employed as a lubricating oil for other applications, including use as a chain oil, jet engine oil, gas turbine oil, compressor oil, hydraulic system oil, gear oil, or as a base oil for bearing grease.

DETAILED DESCRIPTION OF THE INVENTION

Figure 1:
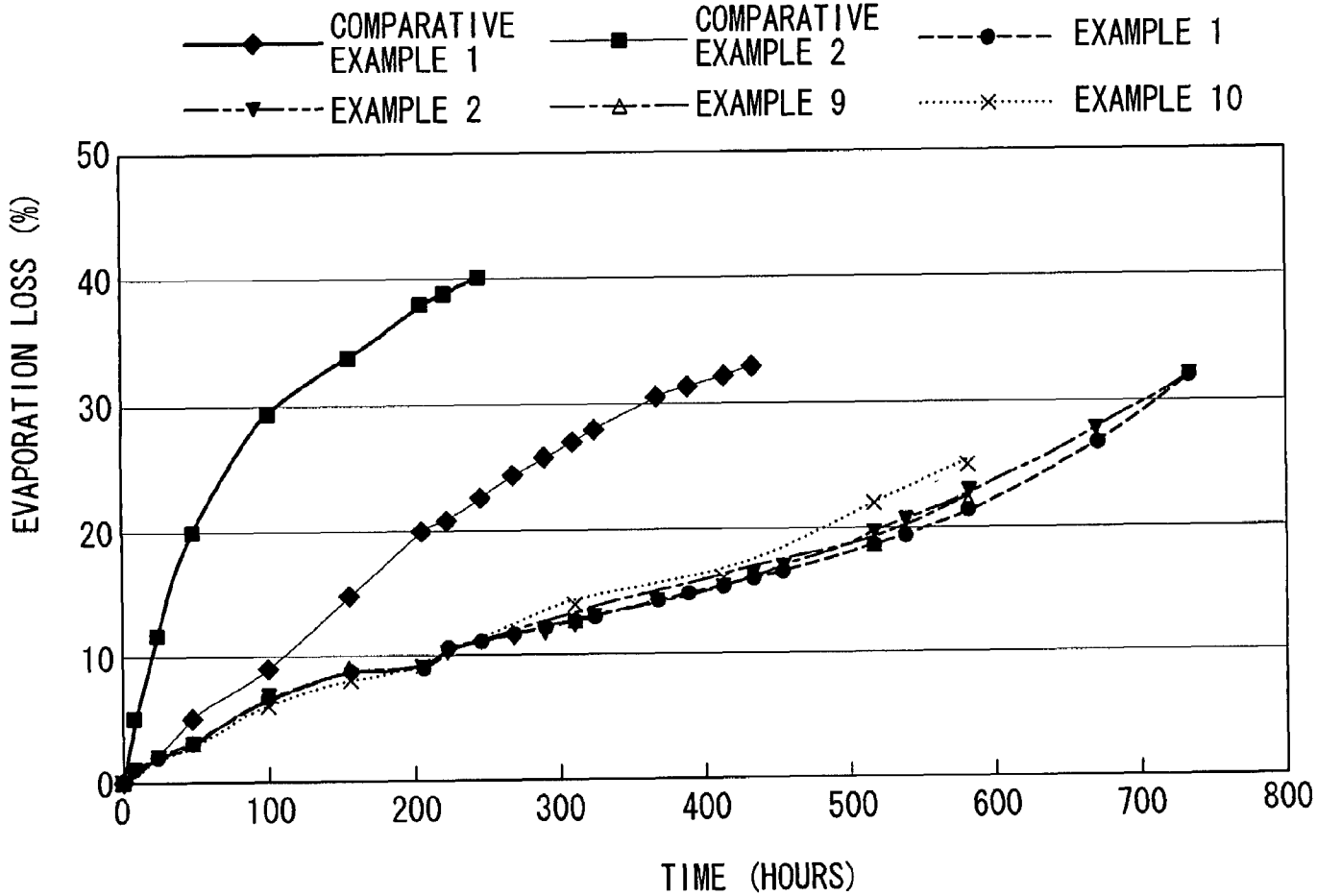
FIG. 1 is a graph showing the results of evaporation loss tests (secondary performance tests) for oil samples from Examples 1, 2, 9, and 10 and Comparative Examples 1 and 2.

As follow is a description of embodiments of a high-temperature lubricating oil composition according to the present invention.

A polyolester based oil is used as the base oil for a lubricating oil composition of the present invention, as such polyolester based oils are resistant to hardening, suffer minimal evaporation loss, and offer excellent high-temperature stability. The quantity of the polyolester based oil within the lubricating oil composition is preferably within a range from 85 to 95% by weight of the total weight of the composition. If the quantity of the polyolester based oil exceeds 95% by weight, then the quantities of antioxidants and lubrication additives within the composition become very low, causing an increase in evaporation loss and a deterioration in the load bearing capacity.

In contrast, if the quantity of the polyolester based oil is less than 85% by weight of the lubricating oil composition, then the antioxidants can become prone to hardening caused by supersaturation. The quantity of the polyolester based oil is even more preferably within a range from 85% to 95% by weight.

The polyolester based oil can use those oils typically used as the base oils of conventional high-temperature lubricating oils, and oils in which the alcohol component is dipentaerythritol, pentaerythritol, trimethylolpropane or neopentyl glycol are particularly suitable. There are no particular restrictions on the acid component of the polyolester based oil, which can be selected on the basis of achieving a lubricating oil viscosity that falls within a desired range. Examples of suitable acid components include straight chain or branched chain, saturated or unsaturated fatty acids of 6 to 10 carbon atoms. Of these, branched chain fatty acids are preferred. Specific examples of suitable acids include octanoic acid, decanoic acid, trimellitic acid, and isononanoic acid, and of these, isononanoic acid is particularly suitable from the viewpoint of viscosity.

A diphenylamine derivative of a lubricating oil composition of the present invention functions as an antioxidant, and suppresses evaporation loss from the lubricating oil composition. The quantity of the diphenylamine derivative within a lubricating oil composition of the present invention is preferably within a range from 2 to 8% by weight of the total weight of the composition. If the quantity of the diphenylamine derivative exceeds 8% by weight, then the evaporation loss becomes constant, and no additional effect is achievable. Furthermore, if the quantity of the diphenylamine derivative is too large, then supersaturation of the derivative itself can actually cause hardening. In contrast, if the quantity of the diphenylamine derivative amounts to less than 2% by weight of the total weight of the lubricating oil composition, then the effect of the additive in suppressing evaporation loss is inadequate. The quantity of the diphenylamine derivative is even more preferably within a range from 3 to 7% by weight, and is most preferably approximately 6% by weight.

The diphenylamine derivative is a compound with a structural formula shown below.

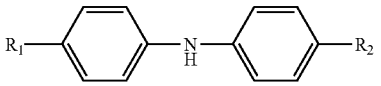

In the above structural formula, $R_1$ and $R_2$ each represent an arylalkyl group with a number average molecular weight (Mn) within a range from 400 to 800. One specific example of the groups $R_1$ and $R_2$ is a dimethylbenzyl group. $R_1$ and $R_2$ may be either identical groups, or different groups.

Any compound with the structural formula described above can be used as the diphenylamine derivative of the present invention, although 4,4-bis(dimethylbenzyl)diphenylamine, represented by a structural formula shown below, is particularly desirable.

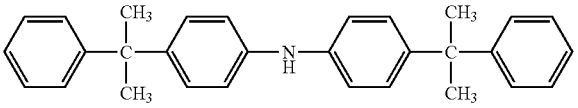

A fatty acid can be added to the polyolester based synthetic oil as a base oil component to improve the lubrication properties (the load bearing capacity) of the lubricating oil composition.

The quantity of fatty acid within the lubricating oil composition is preferably no more than 10% by weight. If the quantity of the fatty acid exceeds 10% by weight, then the lubricating oil composition suffers an undesirable loss of heat resistance.

Furthermore, although there are no particular restrictions on the lower limit of the quantity of fatty acid incorporated within the composition, in order to ensure satisfactory load bearing capacity, the quantity is preferably at least 1% by weight.

Examples of suitable fatty acids include the $C_{12}$ to $C_{72}$ fatty acids represented by a structural formula shown below.

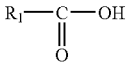

In the above structural formula, $R_1$ represents a $C_{11}$ to $C_{71}$ straight chain or branched chain hydrocarbon group. This hydrocarbon group may be either saturated or unsaturated. Representative examples of suitable saturated fatty acids include lauric acid ($C_{12}$), myristic acid ($C_{14}$), palmitic acid ($C_{16}$), and stearic acid ($C_{18}$), and representative examples of suitable unsaturated fatty acids include oleic acid and linoleic acid (both $C_{18}$), although the present invention is in no way restricted to these acids. Furthermore, the fatty acid may be either substituted or unsubstituted. In addition, the fatty acid may also comprise a mixture of the different fatty acids described above.

In addition to the components described above, one or more known additives typically employed in conventional lubricating oil compositions may also be blended into a lubricating oil composition of the present invention to further improve the performance of the composition. Examples of such additives include antioxidants, oiliness and friction modifiers, anti-wear agents, extreme pressure agents, metal-based cleaning agents, viscosity index improvers, pour point depressants, metal deactivators, metal corrosion inhibitors, rust inhibitors, and antifoaming agents.

There are no particular restrictions on the method of producing a lubricating oil composition of the present invention, and each of the components described above can simply be blended together using a typical heated mixing device.

As follows is a description of specifics of the present invention based on a series of examples and comparative examples, although the present invention is in no way limited to the examples presented below, and many modifications are possible without departing from the scope of the appended claims.

EXAMPLES 1 AND 2, AND COMPARATIVE EXAMPLES 1 AND 2

Samples of lubricating oil compositions were prepared with the respective compositions shown in Table 1. In the table, the quantity of each component is expressed as a weight percentage. The oil samples of Comparative Examples 1 and 2 were commercially available products.

TABLE 1

| | Example 1 | Example 2 | Comparative Example 1 | Comparative Example 2 |
|---|---|---|---|---|
| Base oil (ester) | fatty acid ester 90 | fatty acid ester 92 | 94 | 60 |
| Acid component | isononanoic acid (branched) | fatty acid ($C_6$ to $C_{10}$) | | |
| Alcohol component | dipentaerythritol | dipentaerythritol | | |
| Base oil (non-ester component) | fatty acid ($C_{12}$ to $_{72}$) 2 | | | |
| Lubrication additive | phosphorus based additive A 2 | phosphorus based additive A 2 | phosphorus based additive B 2 | |
| Thermal - chemical stability additive | | | | |
| Amine based additive | 4,4-bis(dimethylbenzyl) diphenylamine 6 | 4,4-bis(dimethylbenzyl) diphenylamine 6 | amine based additive A 4 | amine based additive A + amine based additive B 4 |

TABLE 1-continued

| | Example 1 | Example 2 | Comparative Example 1 | Comparative Example 2 |
|---|---|---|---|---|
| Other additive | | | | dioctylnaphthalene 15 |
| Unknown | | | | 21 |

EXAMPLES 3 AND 4

With the exception of changing the quantity of 4,4-bis (dimethylbenzyl)diphenylamine from 6% by weight to 3% by weight and 1% by weight respectively, oil samples of Examples 3 and 4 were prepared using the same components as Example 1.

EXAMPLE 5

With the exception of changing the quantity of fatty acid to 0% by weight (that is, removing the component), an oil sample of Example 5 was prepared using the same components as Example 1.

EXAMPLES 6 TO 11

Lubricating oil compositions were prepared with the respective compositions shown in Table 2. In the table, the quantity of each component is expressed as a weight percentage.

TABLE 2

| | Example 6 | Example 7 | Example 8 | Example 9 | Example 10 |
|---|---|---|---|---|---|
| Base oil (polyolester) | fatty acid ester 98 | fatty acid ester 93 | fatty acid ester 92 | fatty acid ester 92 | fatty acid ester 94 |
| Acid component | isononanoic acid | isononanoic acid | isononanoic acid | isononanoic acid | isononanoic acid |
| Alcohol component | dipentaerythritol | dipentaerythritol | dipentaerythritol | dipentaerythritol | dipentaerythritol |
| Base oil (non-ester component) | fatty acid ($C_{12}$ to $C_{72}$) 0 | fatty acid ($C_{12}$ to $C_{72}$) 0 | fatty acid ($C_{12}$ to $C_{72}$) 0 | fatty acid ($C_{12}$ to $C_{72}$) 2 | fatty acid ($C_{12}$ to $C_{72}$) 0 |
| Lubrication additive | phosphorus based additive A 0 | phosphorus based additive A 0 | phosphorus based additive A 0 | phosphorus based additive A 0 | phosphorus based additive A 0 |
| Thermal - chemical stability additive | 4,4-bis-(dimethylbenzyl) diphenylamine 2 | 4,4-bis-(dimethylbenzyl) diphenylamine 7 | 4,4-bis-(dimethylbenzyl) diphenylamine 8 | 4,4-bis-(dimethylbenzyl) diphenylamine 6 | 4,4-bis-(dimethylbenzyl) diphenylamine 6 |

EXAMPLES 11 TO 14

Lubricating oil compositions were prepared with the respective compositions shown in Table 3. In the table, the quantity of each component is expressed as a weight percentage.

TABLE 3

| | Example 11 | Example 12 | Example 13 | Example 14 |
|---|---|---|---|---|
| Base oil (polyolester) | fatty acid ester 97 | fatty acid ester 88 | fatty acid ester 100 | fatty acid ester 92 |
| Acid component | isononanoic acid | isononanoic acid | isononanoici acid | isononanoic acid |
| Alcohol component | dipentaerythritol | dipentaerythritol | dipentaerythritol | dipentaerythritol |
| Lubrication additive | phosphorus based additive A 2 | phosphorus based additive A 2 | phosphorus based additive A 0 | phosphorus based additive A 0 |
| Base oil (non-ester component) | fatty acid ($C_{12}$ to $_{72}$) 1 | fatty acid ($C_{12}$ to $_{72}$) 10 | fatty acid ($C_{12}$ to $_{72}$) 0 | fatty acid ($C_{12}$ to $_{72}$) 2 |
| Thermal - chemical stability additive | 4,4-bis(dimethylbenzyl) diphenylamine 0 | 4,4-bis(dimethylbenzyl) diphenylamine 0 | 4,4-bis(dimethylbenzyl) diphenylamine 0 | 4,4-bis(dimethylbenzyl) diphenylamine 6 |

(Evaporation Loss Testing, Secondary Performance Tests)

Oil samples of approximately 5 g from each of Examples 1, 2, 9, and 10, and Comparative Examples 1 and 2 were placed in individual heat resistant glass beakers of capacity 10 cc. 2.5 g of iron powder (JIS SCM440) was added to each beaker, and the beakers were then heated in an oven at 200° C. for 720 hours. The variation in evaporation loss over time for each oil sample is showed in FIG. 1.

Figure 2:
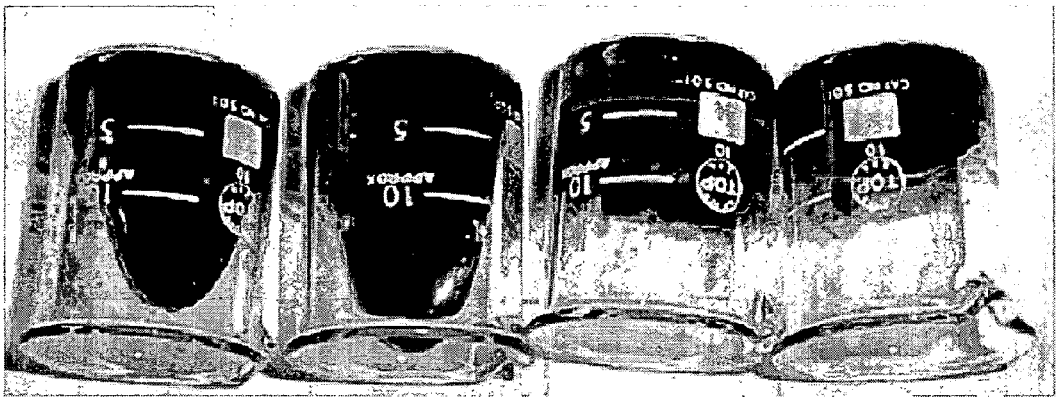
FIG. 2 is a photograph showing the state of oil samples from Examples 1 and 2, and Comparative Examples 1 and 2 during the evaporation loss tests (secondary performance tests).

Furthermore, the state of four of the oil samples after heating for 700 hours is shown in FIG. 2.

From FIG. 1 and FIG. 2 it is evident that the oil samples from Examples 1 and 2 did not harden, but rather retained excellent fluidity, even after heating for 700 hours, thus offering far superior heat resistance to the oil samples of Comparative Examples 1 and 2.

Furthermore, Example 9, which contained no lubrication additives, and Example 10, which contained no lubrication additives and no fatty acid, displayed similar results (at 600 hours).

(Evaporation Loss Testing, Primary Performance Tests)

Oil samples of approximately 5 g from each of Examples 1, 3, 4, 6, 7, and 8 were placed in individual heat resistant glass beakers of capacity 10 cc, and the beakers were then left to stand in an oven at 200° C. for 400 hours. The variation in evaporation loss over time for each oil sample is showed in FIG. 3.

Figure 3:
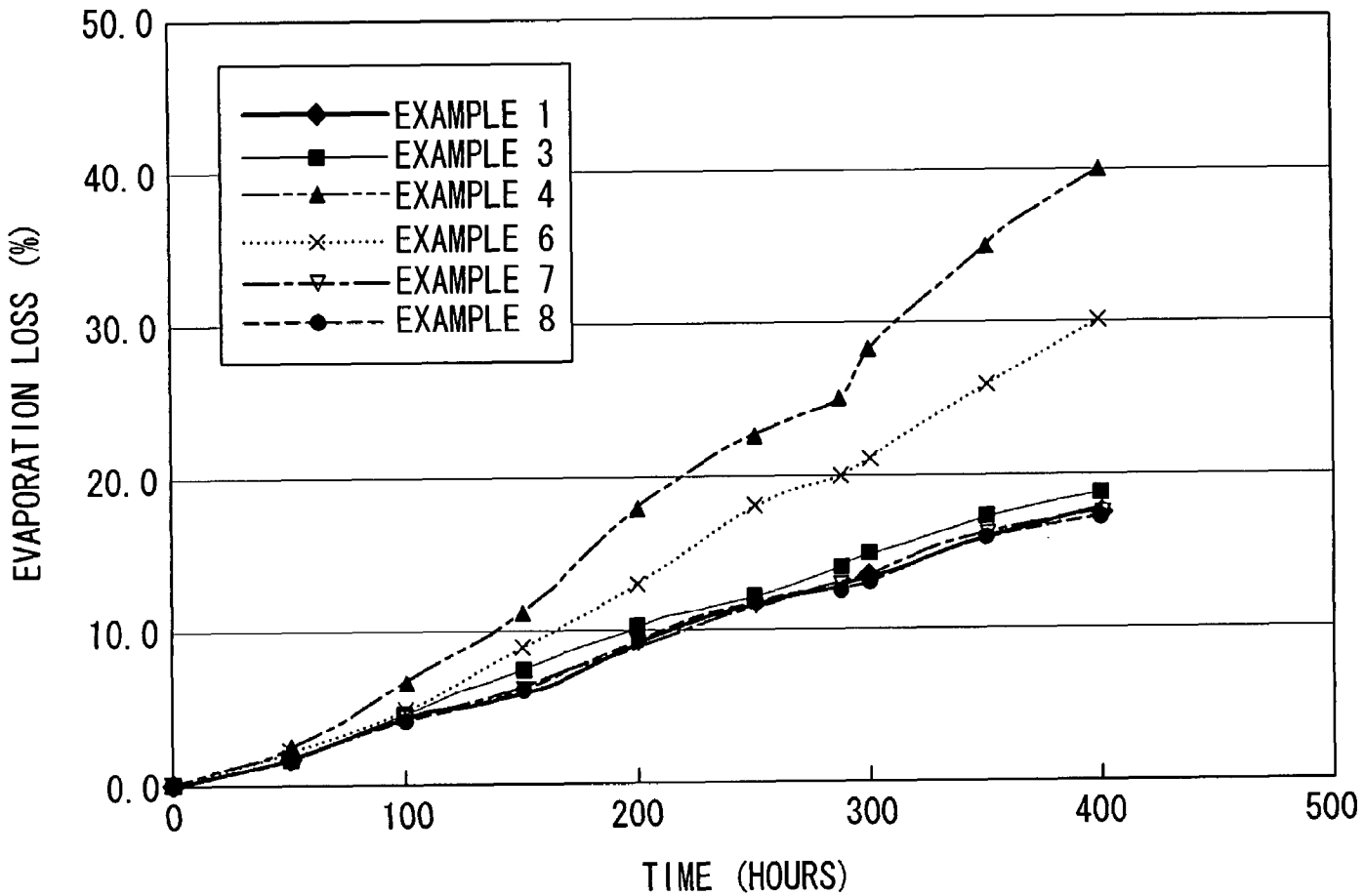
FIG. 3 is a graph showing the results of evaporation loss tests (primary performance tests) for oil samples from Examples 1, 3, 4, and 6 to 8.

From the results shown in FIG. 3 it is evident that whereas Examples 1, 3, 4, and 6 all displayed excellent heat resistance, the oil sample of Example 1, which contained 6% by weight of 4,4-bis(dimethylbenzyl)diphenylamine provided the best heat resistance, followed closely by the oil sample of Example 3, which contained 3% by weight of 4,4-bis(dimethylbenzyl)diphenylamine. The oil samples of Examples 7 and 8 displayed similar results to Example 1.

(Soda Four-Ball Testing)

Oil samples from Examples 1, 5, 11, 12, 13, and 14 were subjected to testing with a Soda four-ball tester, under conditions including a revolution speed of 200 rpm, and a load step-up rate of 0.5 kg/min, and the point at which the coefficient of friction altered (the point where the oil film became extremely thin, causing metal contact) was measured, and recorded as the loading capacity. The results are shown in FIG. 4.

Figure 4:
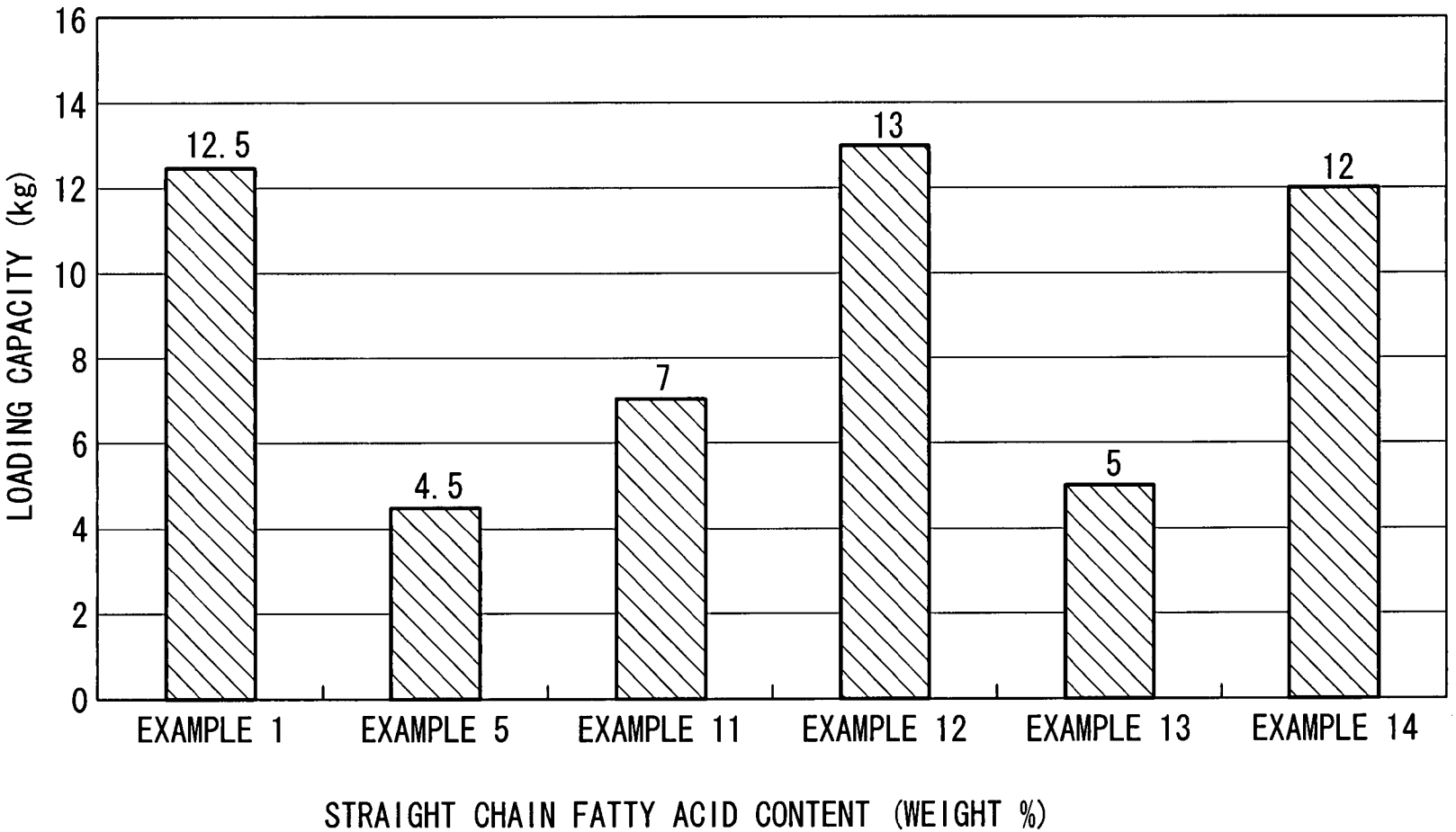
FIG. 4 is a graph showing the results of Soda four-ball tests on oil samples of Examples 1, 5 and 11 to 14.

From the results shown in FIG. 4 it is evident that the oil samples of Examples 11 and 12, which contained a fatty acid, had a larger loading capacity and offered more favorable lubrication properties than the oil sample of Example 5, which contained no fatty acid. The oil sample of Example 1, which contained 2% by weight of fatty acid provided an increase in loading capacity of almost three fold over that of the oil sample of Example 5, which contained no fatty acid. Furthermore, the oil samples of Examples 13 and 14, from which the phosphorus based lubrication additive A had been removed, displayed unchanged lubrication properties from those of Example 1.

(Immersion Testing)

Test specimens formed from vinyl methyl silicone (VMQ) rubber were immersed in separate oil samples from Example 1, and Comparative Examples 1 and 2, and were left to stand at 185° C. After 168 hours, the test specimens were removed and inspected for evidence of elution. The state of the test specimen following immersion in the oil sample from Comparative Example 1 is shown in FIG. 5, the state of the test specimen following immersion in the oil sample from Comparative Example 2 is shown in FIG. 6, and the state of the test specimen following immersion in the oil sample from Example 1 is shown in FIG. 7.

Figure 5:
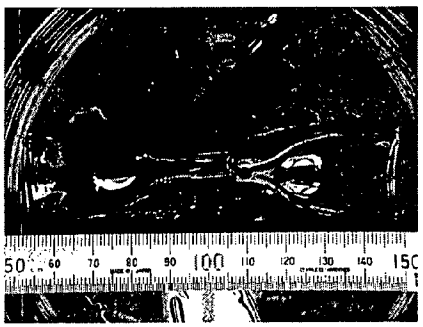
FIG. 5 is a photograph showing the state of a test specimen following immersion in an oil sample of Comparative Example 1.
Figure 6:
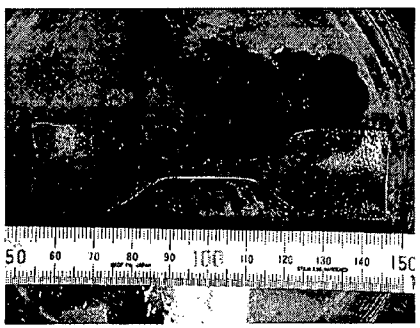
FIG. 6 is a photograph showing the state of a test specimen following immersion in an oil sample of Comparative Example 2.
Figure 7:
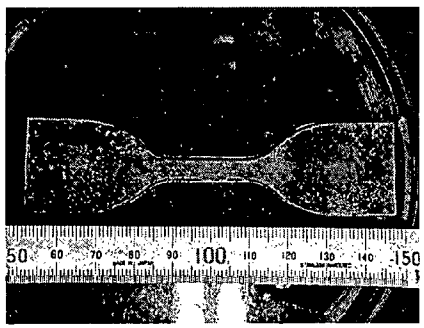
FIG. 7 is a photograph showing the state of a test specimen following immersion in an oil sample of Example 1.

As is evident from FIG. 5 through FIG. 7, whereas no elution was observed for the test specimen immersed in the oil of Example 1, elution was observed for the test specimens immersed in the oil samples of Comparative Examples 1 and 2.

What is claimed is:

1. A lubricating oil composition comprising a base oil component consisting of a polyolester based synthetic oil, wherein the alcohol component is dipentaerythritol and the acid component is isononanoic acid, a $C_{12}$ to $C_{72}$ fatty acid, and a diphenylamine derivative containing an arylalkyl group with a number average molecular weight of 400 to 800, wherein an amount of said diphenylamine derivative is within a range from 6% to 8% by weight based on the total weight of the lubricating oil composition.

2. The lubricating oil composition according to claim 1, wherein said diphenylamine derivative is 4,4-bis(dimethylbenzyl)diphenylamine.

3. The lubricating oil composition according to claim 1, wherein an amount of said fatty acid is at least 1% by weight and not more than 10% by weight based on the total weight of the lubricating oil composition.

4. The lubricating oil composition according to claim 1, wherein an amount of said fatty acid is approximately 2% by weight based on the total weight of the lubricating oil composition.

5. The lubricating oil composition according to claim 1, wherein said fatty acid comprises an unsaturated fatty acid.

6. The lubricating oil composition according to claim 1, wherein said fatty acid comprises a saturated fatty acid.

7. The lubricating oil composition according to claim 1, further comprising a phosphorous based additive.

8. A lubricating oil composition comprising a base oil component comprising a polyolester based synthetic oil, wherein said polyolester based synthetic oil consists of a dipentaerythritol as an alcohol component and an isononanoic acid as an acid component, a $C_{12}$ to $C_{72}$ fatty acid, and a diphenylamine derivative containing an arylalkyl group with a number average molecular weight of 400 to 800, wherein an amount of said diphenylamine derivative is within a range from 6% to 8% by weight based on the total weight of the lubricating oil composition.

9. The lubricating oil composition according to claim 8, wherein said diphenylamine derivative is 4,4-bis(dimethylbenzyl)diphenylamine.

10. The lubricating oil composition according to claim 8, wherein an amount of said fatty acid is at least 1% by weight and not more than 10% by weight based on the total weight of the lubricating oil composition.

11. The lubricating oil composition according to claim 8, wherein an amount of said fatty acid is approximately 2% by weight based on the total weight of the lubricating oil composition.

12. The lubricating oil composition according to claim 8, wherein said fatty acid comprises an unsaturated fatty acid.

13. The lubricating oil composition according to claim 8, wherein said fatty acid comprises a saturated fatty acid.

14. The lubricating oil composition according to claim 8, further comprising a phosphorous based additive.

15. A method for lubricating a machine comprising adding the lubricating oil composition of claim 1 to said machine.

16. The method for lubricating a machine of claim 15, wherein said machine is an open system machine.

17. The method for lubricating a machine of claim 15, wherein said machine is selected from the group consisting of a tenter, a jet engine, a gas turbine, and a compressor.

18. The method for lubricating a machine of claim 17, wherein said machine is a tenter.

19. The method for lubricating a machine of claim 15, wherein said oil lubricates a gear or a bearing.

20. The method for lubricating a machine of claim 15, wherein said machine comprises a hydraulic system and said lubricating oil composition is added to said hydraulic system.

21. A method for lubricating a machine comprising adding the lubricating oil composition of claim 8 to said machine.

22. The method for lubricating a machine of claim 21, wherein said machine is an open system machine.

23. The method for lubricating a machine of claim 21, wherein said machine is selected from the group consisting of a tenter, a jet engine, a gas turbine, and a compressor.

24. The method for lubricating a machine of claim 23, wherein said machine is a tenter.

25. The method for lubricating a machine of claim 21, wherein said oil lubricates a gear or a bearing.

26. The method for lubricating a machine of claim 21, wherein said machine comprises a hydraulic system and said lubricating oil composition is added to said hydraulic system.

* * * * *